US005871898A

United States Patent [19]

Mifune et al.

[11] Patent Number: 5,871,898

[45] Date of Patent: Feb. 16, 1999

[54] SILVER HALIDE PHOTOGRAPHIC EMULSION

[75] Inventors: Hiroyuki Mifune; Tetsuro Kojima, both of Kanagawa, Japan

[73] Assignee: Fuji Photo Film Co., Ltd., Kanagawa, Japan

[21] Appl. No.: 691,951

[22] Filed: Aug. 5, 1996

[30] Foreign Application Priority Data

Aug. 9, 1995 [JP] Japan ..... 7-222783

[51] Int. Cl.[6] ..... G03C 1/08

[52] U.S. Cl. ..... 430/603; 430/600; 430/613

[58] Field of Search ..... 430/600, 603, 430/611, 613, 569

[56] References Cited

U.S. PATENT DOCUMENTS 2,278,947 4/1942 Riester .

2,937,090 5/1960 Kennard ..... 430/603

4,266,018 5/1981 Ishiguro et al. .

4,607,006 8/1986 Hirano et al. ..... 430/600

5,266,457 11/1993 Kojima et al. .

FOREIGN PATENT DOCUMENTS 5-165135 6/1993 Japan .

*Primary Examiner*—Thorl Chea

*Attorney, Agent, or Firm*—Birch, Stewart, Kolasch & Birch, LLP

[57] ABSTRACT

A silver halide photographic emulsion is disclosed, which is chemically sensitized with a compound having an adsorptive group onto silver halide and a labile sulfur moiety, and further a silver halide photographic material using the same emulsion is disclosed.

16 Claims, No Drawings

SILVER HALIDE PHOTOGRAPHIC EMULSION

FIELD OF THE INVENTION

The present invention relates to a silver halide photographic emulsion and, specifically, to a silver halide photographic emulsion which is improved in fog, storage stability and sensitivity, in particular, spectral sensitivity, and to a silver halide photographic material using the same.

BACKGROUND OF THE INVENTION

In recent years, demands for high sensitivity, excellent graininess, gradation, high sharpness and excellent storage stability in silver halide photographic materials and, further, for rapid processing accelerating rate of development and the like have increasingly become severe. In particular, demands for good storage stability while suppressing fog in low level and further for higher sensitization have been strong.

A silver halide emulsion for use in a silver halide photographic material is, in general, chemically sensitized with various chemical substances for obtaining desired sensitivity and gradation.

Specifically, chalcogen sensitization such as sulfur sensitization, selenium sensitization and tellurium sensitization, noble metal sensitization using noble metals, such as gold, and reduction sensitization using reducing agents are used alone or in combination.

Of these sensitizing methods, that which is most widely and generally used and fundamental in combined sensitizing methods is a sulfur sensitizing method using labile sulfur compounds, and specific examples thereof are disclosed in P. Glafkides, *Chimie et Physique Photoqraphigue,* 5th Ed., Paul Montel (1987), T. H. James, *The Theory of the Photographic Process,* 4th Ed., Macmillan (1977), H. Frieser, *Die Grundlaqen der Photoqraphischen Prozesse mit Silver haloqeniden,* Akademische Verlagsgesellshaft (1968), U.S. Pat. Nos. 1,574,944, 1,623,449, 2,278,947, 2,410,689, 2,440,206, 2,449,153, 2,728,668, 3,189,458, 3,501,313, 3,656,955, 4,030,928, 4,054,457, 4,067,740, 4,266,018, 4,810,626, German Patents 1,422,869, 1,572,260, 228,658, 235,929, British Patents 1,129,356, 99,701, 1,403,980, European Patents 61,446, 138,622, JP-A-63-5355 (the term "JP-A" as used herein means an "unexamined published Japanese patent application"), JP-A-63-5336, JP-A-63-229449, JP-A-58-80634, JP-A-1-114839, JP-A-1-227140, JP-A-5-165135, JP-B-58-30570 (the term "JP-B" as used herein means an "examined Japanese patent publication"), JP-B-60-24457, JP-B-62-17216 and *Research Disclosure,* Vol. 307, No. 307105.

In recent years, high sensitivity while maintaining excellent graininess and high sharpness of silver halide photographic materials, further, high temperature rapid processing for increasing the processing rate and higher sensitization in high temperature forced development (by prolonging the processing time) have been strongly desired, however, by which the generation of fog and soft gradation are concurrently liable to be enlarged. Accordingly, the improvements of the above-described sulfur sensitization and combined sensitization with a sulfur sensitizing method as a fundamental such as a sulfur-gold sensitizing method and a sulfur-selenium-gold sensitizing method have been desired.

Silver halide photographic emulsions are, in general, spectrally sensitized with sensitizing dyes to have photographic sensitivity in wavelength regions such as green, red and infrared regions where silver halide per se does not have absorption.

The increase of the amount of sensitizing dyes used to increase the spectral sensitivity is often conducted, which, at the same time, causes the increase in reduction of the sensitivity in the intrinsic wavelength region, that is, the intrinsic desensitization, presumably due to development inhibition by the dyes, latent image dispersion, or nullification of photoelectron by the hole of the dyes and the bleaching of latent images or the like. As a result, the spectral sensitivity reaches a top limit and does not increase further.

In addition, the sensitivity fluctuation becomes large (mainly desensitization) during storage with the lapse of time by the use of large amount of dyes. Heretofore, various efforts have been done to still further increase the spectral sensitivity stably but yet insufficient.

In particular, the development of useful and universal techniques of chemical sensitization has been eagerly demanded to reduce the intrinsic desensitization by sensitizing dyes and to improve spectral sensitivity stably.

SUMMARY OF THE INVENTION

Accordingly, one object of the present invention is to provide a silver halide photographic emulsion having high sensitivity.

Another object of the present invention is to provide a silver halide photographic emulsion which is low in fog, excellent in storage stability and has high sensitivity, and to provide a silver halide photographic material using the same.

Another object of the present invention is to provide a silver halide photographic emulsion which is improved in intrinsic desensitization by a sensitizing dye and has high spectral sensitivity, and to provide a silver halide photographic material using the same.

These and other objects of the present invention have been achieved by a silver halide photographic emulsion chemically sensitized with a compound which has an adsorptive group onto silver halide and a labile sulfur moiety, and a photographic material using the same.

DETAILED DESCRIPTION OF THE INVENTION

A compound which has an adsorptive group onto silver halide and a labile sulfur moiety for use in the present invention is specifically represented by formula (I):

$$A—[(W)_n—Z]_m \quad (I)$$

wherein A represents an atomic group containing a group capable of adsorbing onto silver halide; Z represents an atomic group containing a labile sulfur moiety; W represents a divalent linking group; n represents 0 or 1; and m represents 1, 2 or 3.

Formula (I) is explained in detail below.

In formula (I), specific examples of atomic groups containing a group capable of adsorbing onto silver halide which are represented by A include an atomic group having a mercapto group (e.g., mercaptotetrazole, mercaptotriazole, mercaptoimidazole, mercaptothiadiazole, mercaptooxathiazole, mercaptobenzothiazole, mercaptobenzoxazole, mercaptobenzimidazole, mercaptotetraazaindene, mercaptopyridyl, mercaptoaryl), an atomic group having a thione group (e.g., thiazoline-2-thione, imidazoline-2-thione, benzimidazoline-2-thione, benzothiazoline-2-thione), and an atomic group forming imino silver (e.g., benzotriazole, tetrazole, hydroxyazaindene, benzimidazole, indazole).

Preferred of these groups are an atomic group having a mercapto group and an atomic group having a thione group. Further, a mercapto group substituted on a nitrogen-containing heterocyclic group or an aryl group is particularly preferred.

In formula (I), specific examples of atomic groups containing a labile sulfur moiety represented by Z include a thiourea group (e.g., N',N'-diphenylthiourea, N,N'-diethylthiourea, N-ethyl-N'-(4-methyl-2-thiazolyl)thiourea, N,N'-ethylenethiourea, and, in particular, a substituted group at the 1-, 2- or 3-position is preferred), a thioamide group (e.g., N-methylphenylthioamide, N-ethylnaphthylthioamide, in particular, enolizable —C(=S)NH— is preferred), a phosphine sulfide group (e.g., dimethylphosphine sulfide, diethylphosphine sulfide), a rhodanine group (e.g., diethyl rhodanine, 5-benzylidene rhodanine, rhodanine), a thiohydantoin group (e.g., 1,3-diphenyl-2-thiohydantoin, 4-benzylidene-1-phenyl-2-thiohydantoin), a 4-oxooxazolidine-2-thione group (e.g., a 5,5-dimethyl-4-oxooxazolidine-2-thione, 3-ethyl-4-oxooxazolidine-2-thione, 3-benzyl-4-oxooxazolidine-2-thione), a polysulfide group, a dithiazolidine group, and a thiocarbamate group.

Of these groups, preferred are a thiourea group, a thioamide group, a phosphine sulfide group and a rhodanine group.

In formula (I), the divalent linking group represented by W is a divalent linking group consisting of a carbon atom, a hydrogen atom, an oxygen atom, a nitrogen atom or a sulfur atom, and specific examples thereof include an alkylene group having from 1 to 20 carbon atoms (e.g., methylene, ethylene, trimethylene, tetramethylene, hexamethylene), an arylene group having from 6 to 20 carbon atoms (e.g., phenylene, naphthylene), —$CONR_1$—, —$SO_2NR_2$—, —O—, —S—, —$NR_3$—, —$NR_4CO$—, —$NR_5SO_2$—, —$NR_6CONR_7$—, —COO—, —OCO—, —CO—, —$SO_2$— and groups combining these linking groups; $R_1$, $R_2$, $R_3$, $R_4$, $R_5$, $R_6$ and $R_7$ each represents a hydrogen atom, an aliphatic group (preferably having 1 to 12 carbon atoms) such as methyl, ethyl, propyl, butyl and hexyl, or an aromatic group such as phenyl and naphthyl.

Specific examples of the compounds represented by formula (I) are shown below but the present invention is not limited thereto.

1.

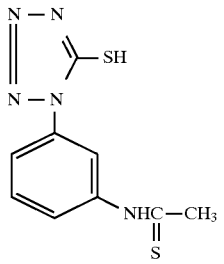

2.

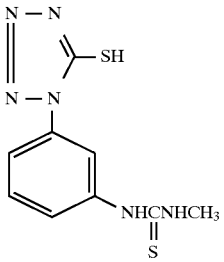

-continued

3.

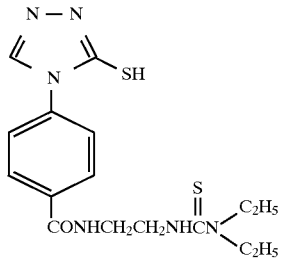

4.

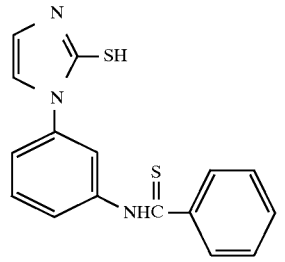

5.

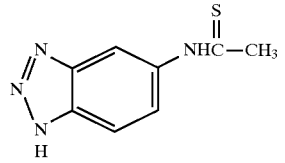

6.

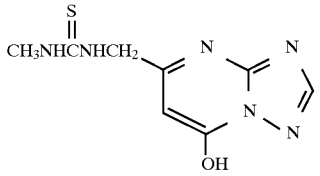

7.

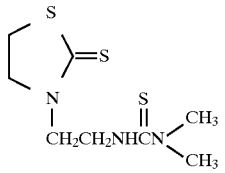

8.

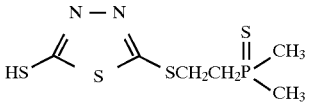

9.

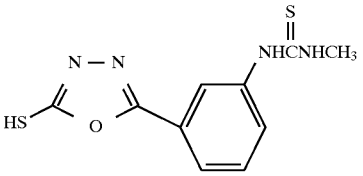

-continued
10.
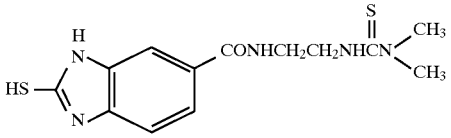
11.
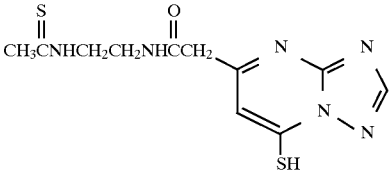
12.
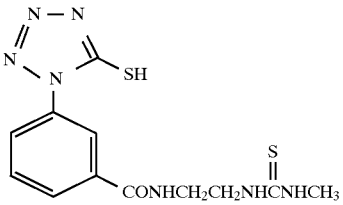
13.
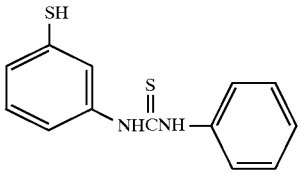
14.
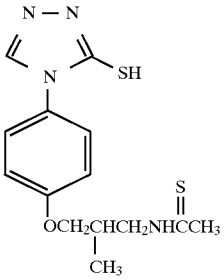
15.
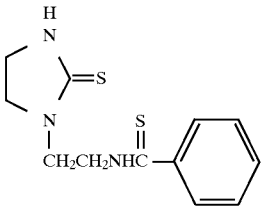
16.
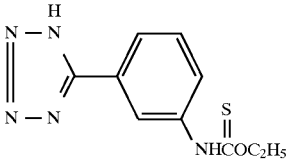
-continued
17.
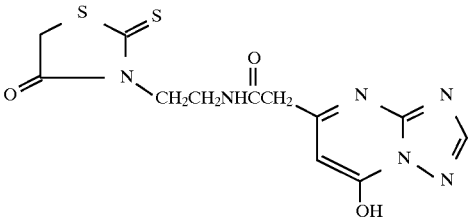
18.
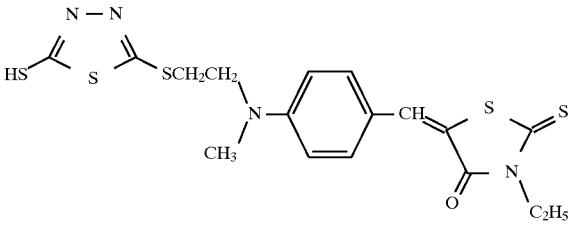
19.
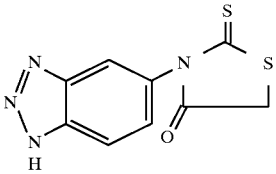
20.
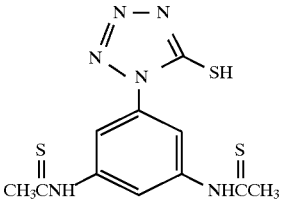
21.
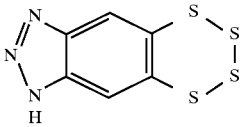
22.
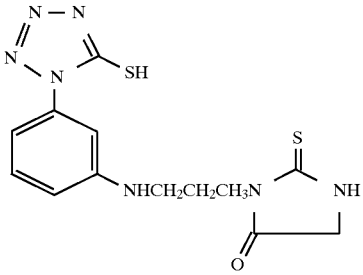
23.
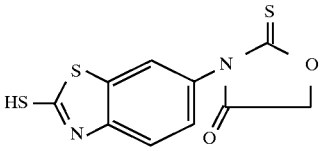

-continued

24.

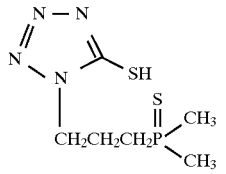

25.

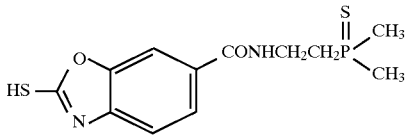

26.

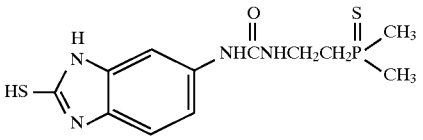

27.

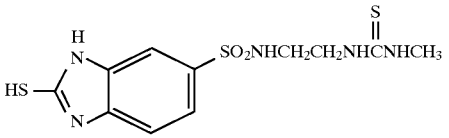

28.

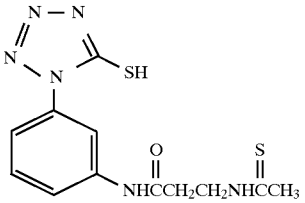

29.

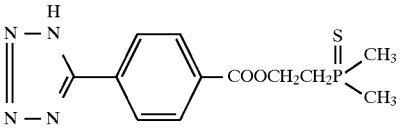

30.

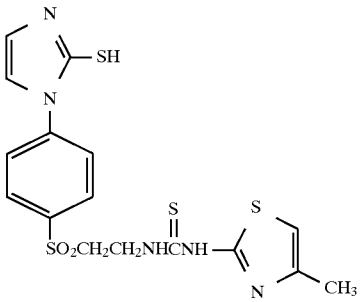

Further, thiocyanates are preferably used in the present invention in addition to the above shown sulfur sensitizers. Thiocyanates to be used are preferably water-soluble thiocyanates, for example, potassium thiocyanate, sodium thiocyanate, or ammonium thiocyanate.

Thiocyanates for use in the present invention may be added at arbitrary time during preparation of a silver halide emulsion, for example, at the time of silver halide grain formation, at washing time, or from before starting chemical sensitization to before completion of chemical sensitization. When sulfur sensitization is carried out using the compound represented by formula (I), thiocyanates preferably coexist.

Although the addition amount of the sulfur compounds represented by formula (I) varies depending on the silver halide grains used and conditions of chemical sensitization, they can be used in an amount of generally from $1\times10^{-8}$ to $1\times10^{-2}$ mol and preferably from $1\times10^{-7}$ to $1\times10^{-3}$ mol, per mol of the silver halide.

Although the addition amount of thiocyanates for use in the present invention varies depending on the silver halide grains used, the time when they are used and conditions of chemical sensitization, they can be used in an amount of generally from $1\times10^{-6}$ to $1\times10^{-1}$ mol and preferably from $1\times10^{-5}$ to $1\times10^{-2}$ mol, per mol of the silver halide.

The condition of sulfur sensitization in the present invention is not particularly limited, but pAg is generally from 6 to 11, preferably from 7 to 10, pH is generally from 4 to 10, preferably from 5 to 8, and the temperature is generally from 40° C. to 95° C., preferably from 45° C. to 85° C.

In the above-described well-known patents in which labile sulfur compounds are disclosed, the use of thiocyanate during chemical sensitization is disclosed but there are absolutely no specific disclosures regarding the combined use of thiocyanate with the compound represented by formula (I) of the present invention.

Conventionally used sulfur compounds, as described in the prior art, do not have at all a functional group which is positively adsorbed onto silver halide other than the labile sulfur moiety. On the contrary, the sulfur compounds of the present invention are characterized in that they are bound to have a functional group positively adsorptive onto silver halide in addition to the labile sulfur moiety. This is essential to manifest the effect of the present invention.

It is preferred to further use conventional sulfur sensitization, selenium sensitization, tellurium sensitization, reduction sensitization and noble metal sensitization to the silver halide photographic emulsion of the present invention alone or in combination.

In addition to the compounds represented by formula (I) of the present invention, usually used sulfur compounds may further be used, if there are no impediments, and in such sulfur sensitization, the labile sulfur compounds disclosed in the above P. Glafkides, *Chimie et Physique Photographique,* 5th Ed., Paul Montel (1987) and *Research Disclosure,* Vol. 307, No. 307105 can be used.

Specific examples thereof include well-known sulfur compounds such as thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethyl rhodanine, 5-benzylidene-N-ethyl rhodanine), phosphine sulfides (e.g., trimethylphosphine sulfide), thiohydantoins, 4-oxooxazolidine-2-thiones, disulfides or polysulfides (e.g., dimorpholine disulfide, cystine, lenthionine) and polythionate, and active gelatins.

In selenium sensitization, labile selenium compounds disclosed in JP-B-43-13489, JP-B-44-15748, JP-A-4-25832, JP-A-4-109340, JP-A-4-271341, JP-A-5-40324, JP-A-5-11385, JP-A-6-51415, JP-A-6-175258, JP-A-6-180478, JP-A-6-208186, JP-A-6-208184, JP-A-6-317867, JP-A-7-92599, JP-A-7-98483 and JP-A-7-140579 can be used.

Specific examples thereof include colloidal metal selenium, selenoureas (e.g., N,N-dimethylselenourea, trifluoromethylcarbonyltrimethylselenourea, acetyltrimethyl-selenourea), selenoamides (e.g. , selenoamide, N,N-diethyl-phenylselenoamide), phosphineselenides (e.g., triphenyl-phosphineselenide, pentafluorophenyldiphenylphosphine-selenide), selenophosphates (e.g., tri-p-tolylseleno-phosphate, tri-n-butylselenophosphate), seleno ketones (e.g., selenobenzophenone), isoselenocyanates, selenocarboxylic acids, seleno esters, and diacylselenides. In addition, non-labile selenium compounds disclosed in JP-B-46-4553 and JP-B-52-34492, such as selenious acid, potassium selenocyanate, selenazoles and selenides can also be used.

Labile tellurium compounds are used in tellurium sensitization, for example, labile tellurium compounds disclosed in JP-A-4-224595, JP-A-4-271341, JP-A-4-33043, JP-A-5-303157, JP-A-6-27573, JP-A-6-175258, JP-A-6-180478, JP-A-6-208186, JP-A-6-208184, JP-A-6-317867, and JP-A-7-140579 can be used.

Specific examples thereof include phosphinetellurides (e.g., butyldiisopropylphosphinetelluride, tributylphosphine-telluride, tributoxyphosphinetelluride, ethoxydiphenyl-phosphinetelluride), diacyl(di)tellurides (e.g., bis-(diphenylcarbamoyl)ditelluride, bis(N-phenyl-N-methyl-carbamoyl)ditelluride, bis(N-phenyl-N-methylcarbamoyl)-telluride, bis(N-phenyl-N-benzylcarbamoyl)telluride, bis-(ethoxycarbonyl)telluride), telluroureas (e.g., N,N'-dimethylethylenetellurourea, N,N'-diphenylethylene-tellurourea), telluroamides and telluro esters.

In noble metal sensitization, noble metal salts of gold, platinum, palladium, and iridium disclosed in P. Glafkides, *Chimie et Physique Photoqraphique,* 5th Ed., Paul Montel (1987) and *Research Disclosure,* Vol. 307, No. 307105 can be used, and gold sensitization is particularly preferred above all. Specific examples of gold compounds which can be used in the present invention include chloroauric acid, potassium chloroaurate, potassium aurithiocyanate, gold sulfide, gold selenide, in addition, gold compounds disclosed in U.S. Pat. No. 2,642,361, 5,049,484, 5,049,485, 5,169,751, 5,252,455, Belgian Patent 691,857 can also be used.

In reduction sensitization, reducing compounds disclosed in P. Glafkides, *Chimie et Physique Photoqraphique,* 5th Ed., Paul Montel (1987), *Research Disclosure,* Vol. 307, No. 307105, and Japanese Patent Application No. 7-78685 can be used. Specific examples thereof include aminoiminomethanesulfinic acid (commonly called as thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sodium sulfite, aldehyde compounds, and hydrogen gas. Reduction sensitization can be carried out in the atmosphere of high pH and excessive silver ion (so-called silver ripening). In particular, reduction sensitization is preferably conducted during silver halide grain formation.

Of these chemical sensitizing methods, the combination with gold sensitization is preferred.

Further, in addition to thiocyanates, silver halide solvents may further be used in chemical sensitization of silver halide in the present invention.

Specific examples thereof include thioether compounds (e.g., the compounds disclosed in U.S. Pat. Nos. 3,021,215, 3,271,157, JP-B-58-30571 and JP-A-60-136736, in particular, 3,6-dithia-1,8-octanediol), 4-substituted thiourea compounds (e.g., the compounds disclosed in JP-B-59-11892 and U.S. Pat. No. 4,221,863, in particular, tetramethylthiourea), in addition, the thione compounds disclosed in JP-B-60-1134, the mercapto compounds disclosed in JP-B-63-29727, the mesoionic compounds disclosed in JP-A-60-163042, the selenoether compounds disclosed in U.S. Pat. No. 4,782,013, the thioether compounds disclosed in JP-A-2-118566, and sulfites. Of these compounds, thioether compounds, 4-substituted thiourea compounds and thione compounds can be particularly preferably used. The addition amount thereof is from $1\times10^{-5}$ to $1\times10^{-2}$ mol per mol of silver halide.

Next, a silver halide emulsion of the present invention and a silver halide photographic material (in some cases, merely a photographic material) using the same are described.

The above-described silver halide photographic material comprises a support having thereon a silver halide emulsion layer.

The silver halide emulsion for use in the present invention is preferably silver bromide, silver iodobromide, silver iodochlorobromide, silver chlorobromide or silver chloride.

Silver halide grains for use in the present invention may have a regular crystal form such as a cubic or octahedral form, an irregular crystal form such as a spherical or tabular form, or a form which is a composite of these forms. Further, mixtures of grains having various crystal forms can be used but grains having regular crystal forms are preferably used.

The interior and the surface layer of the silver halide grains for use in the present invention may comprise different phases or uniform phase. Double structure or multiple structure grains whose iodide composition is different in the interior and the surface layer (in particular, the iodide content of the interior is high) may be preferably used. Also, the grains may be of the type wherein the latent image is primarily formed on the surface (e.g., a negative type emulsion), or of the type wherein the latent image is primarily formed within the grains (e.g., an internal latent image type emulsion, or a pre-fogged direct reversal type emulsion), but is preferably the grains wherein the latent image is primarily formed on the surface. Grains having dislocation lines are preferably used in the present invention.

The silver halide emulsion for use in the present invention preferably contains tabular silver halide grains having an aspect ratio of 3 or more, preferably having an average aspect ratio of from 3 or more to less than 8, and preferably 60% or more of the entire projected area account for such tabular silver halide grains.

The grain size of the tabular grains is preferably from 0.15 to 5.0 $\mu$m and the thickness is preferably from 0.05 to 1.0 $\mu$m.

The average aspect ratio is obtained as arithmetic mean of the aspect ratio of each grain with respect to at least 100 silver halide grains. Further, the average aspect ratio can be obtained as the ratio of the average grain size to the average thickness.

The grain size of regular crystal grains, spherical grains, or steric grains (i.e., bulky grains such as cube and octahedron) is preferably from 0.05 to 3 $\mu$m, more preferably from 0.08 to 2 $\mu$m, and a monodisperse emulsion having a variation coefficient of preferably 20% or less, more preferably 15% or less, is preferred.

Main planes of the tabular grains may be {111} faces or may be {100} faces.

When monodisperse tabular grains are used, further preferred results can be obtained in the present invention. The grain structure and the preparing method of monodisperse tabular grains are according to, for example, the disclosure in JP-A-63-151618. The shape of monodisperse tabular grains is described briefly. Monodisperse tabular grains are grains in which 70% or more of the entire projected area of silver halide grains are hexagonal grains having the ratio of the length of the side having the longest length to the length of the side having the shortest length of 2 or less, and account for tabular silver halide grains having two planes parallel to each other. Further, the variation coefficient of the grain size distribution of the hexagonal tabular silver halide grains [the value obtained by dividing the grain size dispersion (standard deviation) represented by the projected area diameter corresponding to circle by the average grain size] has monodispersibility of 20% or less.

Further, the emulsion of the present invention preferably has dislocation lines. The dislocation lines of tabular grains can be observed directly with the transmission type electron microscope at low temperature as disclosed, for example, in J. F. Hamilton, *Phot. Sci. Eng.,* 11, 57 (1967) and T. Shiozawa, *J. Soc. Phot. Sci. Japan,* 35, 213 (1972).

Further, the silver halide grains can contain silver halide solvents during grain formation for controlling the grain growth, for example, ammonia, potassium thiocyanate, ammonium thiocyanate, thioether compounds (e.g., those disclosed in U.S. Pat. Nos. 3,271,157, 3,574,628, 3,704,130, 4,297,439, 4,276,374), thione compounds (e.g., those disclosed in JP-A-53-144319, JP-A-53-82408, JP-A-55-77737), or amine compounds (e.g., those disclosed in JP-A-54-100717) can be used.

During the process of forming silver halide grains or physical ripening, ruthenium salts, zinc salts, chromium salt, iridium salts or complex salts thereof, rhodium salts or complex salts thereof, iron salts or complex salts thereof may coexist. Iridium salts, iron salts and rhodium salts are particularly preferred.

Gelatin is preferably used as a binder or protective colloid for an emulsion layer or an interlayer of a photographic material, but other hydrophilic colloids may also be used. Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinyl pyrrolidone, polyacrylic acid, polymethacrylic acid, polyacrylamide, polyvinylimidazole, and polyvinylpyrazole.

Tabular grains for use in the present invention can be prepared according to the methods disclosed in Cleve, *Photography Theory and Practice,* page 131 (1930), Gutoff, *Photographic Science and Engineering,* Vol. 14, pages 248 to 257 (1970), U.S. Pat. Nos. 4,434,226, 4,414,310, 4,433,048, 4,439,520 and British Patent 2,112,157.

Acid-processed gelatin and enzyme-processed gelatin as described in *Nihon Kagaku Shashin Kyokai-Shi* (*Bull. Soc. Phot., Japan*), No. 16, page 30 (1966) can be used as well as widely used lime-processed gelatin, and hydrolyzed product of gelatin can also be used.

An arbitrary hydrophilic colloid layer constituting a photographic light-sensitive layer or a backing layer of a photographic material may contain an inorganic or organic hardening agent. Specific examples thereof include chromium salt, aldehydes (e.g., formaldehyde, glyoxal, glutaraldehyde), and N-methylol based compounds (e.g., dimethylolurea). Active halide compounds (e.g., 2,4-dichloro-6-hydroxy-1,3,5-triazine and sodium salts thereof) and active vinyl compounds (e.g., 1,3,-bisvinylsulfonyl-2-propanol, 1,2-bis(vinylsulfonylacetamido)ethane, bis(vinylsulfonylmethyl)-ether or vinyl polymers having a vinylsulfonyl group at side chain) are preferred as they rapidly harden hydrophilic colloid such as gelatin and provide stable photographic characteristics. N-carbamoyl pyridinium salts (e.g., 1-morpholinocarbonyl-3-pyridinio) methanesulfonate) and haloamidinium salts (e.g., 1-(1-chloro-1-pyridinomethylene) are also excellent in view of rapid hardening ability.

A silver halide photographic emulsion for use in the present invention is preferably spectrally sensitized with methine dyes and the like. The dyes which are used include a cyanine dye, a merocyanine dye, a complex cyanine dye, a complex merocyanine dye, a holopolar cyanine dye, a hemicyanine dye, a styryl dye, and a hemioxonol dye. Particularly useful dyes are dyes belonging to a cyanine dye, a merocyanine dye and a complex merocyanine dye. Nuclei which are usually utilized as basic heterocyclic nuclei in cyanine dyes can be applied to these dyes. For example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; the above nuclei to which alicyclic hydrocarbon rings are fused; the above nuclei to which aromatic hydrocarbon rings are fused, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These heterocyclic nuclei may have a substituent on the carbon atoms.

As a nucleus having a ketomethylene structure, a 5-or 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus, or a thiobarbituric acid nucleus can be applied to a merocyanine dye or a complex merocyanine dye.

These sensitizing dyes may be used alone or in combination. A combination of sensitizing dyes is often used for the purpose of supersensitization. Further, dyes which themselves do not have a spectral sensitizing function or materials which substantially do not absorb visible light but show supersensitization can be incorporated in the emulsion with sensitizing dyes. For example, substituted aminostilbene compounds, which are nitrogen-containing heterocyclic nucleus groups (e.g., those disclosed in U.S. Pat Nos. 2,933,390 and 3,635,721), aromatic organic acid-formaldehyde condensation products (those disclosed in U.S. Pat. No. 3,743,510), cadmium salts or azaindene compounds may be contained in the emulsion. The combinations disclosed in U.S. Pat. Nos. 3,615,613, 3,615,641, 3,617,295 and 3,635,721 are particularly useful.

Various compounds can be added to the silver halide photographic emulsion of the present invention for preventing generation of fog or stabilizing photographic performances during production, storage or processing of the photographic material. Such compounds include compounds well-known as an antifoggant or a stabilizer such as azoles, e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5 -mercaptotetrazoles); mercaptopyrimidines; mercaptotriazines; thioketo compounds, e.g., oxazolinethione; azaindenes, e.g., triazaindenes, tetraazaindenes (in particular, 4-hydroxy-6-methyl(1,3,3a,7)tetraazaindene), pentaazaindenes; benzenethiosulfonic acid, benzenesulfinic acid and benzenesulfonic acid amide.

A photographic material may contain one or more surfactants for various purposes of as coating aid, for static charge prevention, improvement of sliding property, emulsifying dispersion, adhesion prevention, and improvement of photographic properties (e.g., development acceleration, increase in contrast and sensitization).

Dyes soluble in water may be contained in a hydrophilic colloid layer of a photographic material as a filter dye or for purposes of irradiation prevention, halation prevention or for other various purposes. An oxonol dye, a hemioxonol dye, a styryl dye, a merocyanine dye, an anthraquinone dye, and an azo dye are preferably used as such dyes. In addition to the above, a cyanine dye, an azomethine dye, a triarylmethane dye and a phthalocyanine dye are also useful. Oil-soluble dyes can be added to a hydrophilic colloid layer by emulsification using an oil-in-water dispersion method.

The photographic material of the present invention can constitute as a multilayer, multicolor photographic material comprising a support having provided thereon at least two light-sensitive layers having different spectral sensitivities each other.

A multilayer color photographic material generally comprises at least one red-sensitive layer, at least one green-sensitive layer and at least one blue-sensitive layer on a support. Arrangement of these layers can be selected optionally according to necessity. In a multilayer color photographic material, light-sensitive layers are preferably arranged in the order of red-sensitive layer, green-sensitive layer and blue-sensitive layer from the support side, in the order of blue-sensitive layer, green-sensitive layer and red-sensitive layer from the support side, or in the order of blue-sensitive layer, red-sensitive layer and green-sensitive layer from the support side. Further, an arbitrary emulsion layer of the same color sensitivity may comprise two or more emulsion layers having different degrees of sensitivities to improve the sensitivity to be attained, or emulsion layers may comprise three layer structure to further improve graininess. Light-insensitive layers may be provided between two or more emulsion layers having the same color sensitivity. The emulsion layer may be arranged in such a way that an emulsion layer having a different color sensitivity is interposed between the emulsion layers having the same color sensitivity. A reflective layer of silver halide fine grains may be provided beneath the high speed layer, in particular, a high speed blue-sensitive layer to improve sensitivity.

Photographic additives for use in the silver halide emulsion of the present invention are disclosed in *Research Disclosure,* No. 17643, No. 18716 and No. 307105 and the locations related thereto are summarized in the table below.

| Type of Additives | RD 17643 (Dec., 1978) | RD 18716 (Nov., 1979) | RD 307105 (Nov., 1989) |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Antifoggants and Stabilizers | pages 24–25 | page 649, right column | pages 868–870 |
| 6. Light Absorbers, Filter Dyes, and Ultraviolet Absorbers | pages 25–26 | page 649, right column to page 650, left column | page 873 |
| 7. Antistaining Agents | page 25, right column | page 650, left to right columns | page 872 |
| 8. Dye image Stabilizers | page 25 | page 650, left column | page 872 |
| 9. Hardening Agents | page 26 | page 651, left column | pages 874–875 |
| 10. Binders | page 26 | page 651, left column | pages 873–874 |
| 11. Plasticizers and Lubricants | page 27 | page 650, right column | page 876 |
| 12. Coating Aids and Surfactants | pages 26–27 | page 650, right column | pages 875–876 |
| 13. Antistatic Agents | page 27 | page 650, right column | pages 876–877 |
| 14. Matting Agents | — | — | pages 878–879 |

Other techniques and inorganic and organic materials which can be used in the present invention are disclosed in the following places of EP-A-436938 and the patents cited in the following places.

| | |
|---|---|
| 1. Layer Structure | line 34, page 146 to line 25, page 147 |
| 2. Yellow Couplers | line 35, page 137 to line 33, page 146, lines 21 to 23, page 149 |
| 3. Magenta Couplers | lines 24 to 28, page 149; line 5, page 3 to line 55, page 25 of EP-A-421453 |
| 4. Cyan Couplers | lines 29 to 33, page 149; line 28, page 3 to line 2, page 40 of EP-A-432804 |
| 5. Polymer Couplers | lines 34 to 38, page 149; line 39, page 113 to line 37, page 123 of EP-A-435334 |
| 6. Colored Couplers | line 42, page 53 to line 34, page 137, lines 39 to 45, page 149 |
| 7. Other Functional Couplers | line 1, page 7 to line 41, page 53, line 46, page 149 to line 3 page 150; line 1, page 3 to line 50, page 29 of EP-A-435334 |
| 8. Antiseptic and Antibacterial Agents | lines 25 to 28, page 150 |
| 9. Formalin Scavengers | lines 15 to 17, page 149 |
| 10. Other Additives | lines 38 to 47, page 153; line 21, page 75 to line 56, page 84, line 40, page 27 to line 40, page 37 of EP-A-421453 |
| 11. Dispersion Methods | lines 4 to 24, page 150 |
| 12. Supports | line 32 to 34, page 150 |
| 13. Film Thickness, Physical Properties of Films | lines 35 to 49, page 150 |
| 14. Color Development Process | line 50, page 150 to line 47, page 151 |
| 15. Desilvering Process | line 48, page 151 to line 53, page 152 |
| 16. Automatic Processors | line 54, page 152 to line 2, page 153 |
| 17. Washing and Stabilizing Processes | lines 3 to 37, page 153 |

Preferred embodiments of the present invention are shown below.

(1) A silver halide photographic emulsion is sulfur-sensitized with a sulfur compound represented by formula (I) which has an adsorptive group onto silver halide and a labile sulfur moiety.

(2) The silver halide photographic emulsion is sulfur-sensitized with a sulfur compound represented by formula (I) in the presence of thiocyanate.

(3) The compound represented by formula (I) is a sulfur compound in which an adsorptive group has a mercapto group, a thione group, or a group forming imino silver.

(4) The adsorptive group in formula (I) is a mercapto group or a thione group.

(5) The adsorptive group in formula (I) is a mercapto group and is substituted on a nitrogen-containing heterocyclic ring or an aryl group.

(6) The atomic group containing a labile sulfur moiety in formula (I) is a thiourea group, a thioamide group, a phosphine sulfide group, a rhodanine group, a thiohydantoin group, a 4-oxooxazolidine-2-thione group, a di- or polysulfide group, a thiocarbamate group or a dithiazolidine group.

(7) The atomic group containing a labile sulfur moiety in formula (I) is a thiourea group, a thioamido group, a phosphine sulfido group or a rhodanine group.

(8) In formula (I), the labile sulfur moiety is a thiourea group, which can be substituted at the 1-, 2- or 3-position, and the labile sulfur moiety is a thioamido group, which is —C(═S)NH—.

(9) Thiocyanate is potassium thiocyanate, sodium thiocyanate, or ammonium thiocyanate.

(10) The silver halide emulsion of the present invention is further reduction-sensitized and the reduction-sensitization is preferably conducted during silver halide grain formation.

(11) The silver halide emulsion of the present invention is further subjected to selenium-sensitization or tellurium-sensitization.

(12) The silver halide emulsion of the present invention is subjected to gold-sensitization.

(13) The silver halide emulsion of the present invention is subjected to chemical-sensitization of a combination of selenium-sensitization or tellurium-sensitization with gold-sensitization.

(14) The silver halide photographic emulsion of the present invention is spectrally sensitized by the addition of a methine dye.

(15) The methine dye in (14) is a cyanine dye.

(16) The silver halide emulsion of the present invention is silver bromide, silver iodobromide, silver iodochlorobromide, silver chlorobromide or silver chloride.

(17) The silver halide emulsion of the present invention comprises regular crystal grains or tabular grains.

(18) The silver halide emulsion grains of the present invention have dislocation lines.

(19) A silver halide photographic material contains at least one silver halide emulsion described in (1) to (18) above.

The present invention is described with reference to specific examples but the present invention is not limited thereto without departing from the spirit and scope thereof.

EXAMPLE 1

To an aqueous solution of gelatin containing potassium bromide and ammonia maintained at 60° C., with stirring, an aqueous solution of silver nitrate and an aqueous solution of potassium bromide were added by a double jet method with maintaining silver potential of +10 mV to a saturated calomel electrode.

After grain formation, the mixed solution was desalted and washed with water by an ordinary flocculation method, then gelatin and water were added to adjust pH and pAg to 6.0 and 8.8, respectively.

The thus-obtained silver bromide emulsion was monodisperse tetradecahedral emulsion having a grain size of 0.8 μm, {111} face/{100} face ratio of 65/35, and variation coefficient of the grain diameter of 10%.

After this emulsion was subdivided, the temperature was raised to 60° C. and potassium thiocyanates shown in Table 1 were added thereto, and after 2 minutes, sulfur compounds were added and the emulsions were ripened for 60 minutes.

After termination of chemical ripening, the emulsions were further divided into two groups, emulsions of one group were left as they were, and to the other group was added anhydro-5-chloro-5'-phenyl-9-ethyl-3,3'-di(3-sulfopropyl)-benzoxacarbocyanine hydroxide sodium salt (a sensitizing dye) (670 mg/mol AgX).

Subsequently, the following compounds were added to each emulsion: 3-{3-[2-(2,4-di-tert-amylphenoxy)butyrylamino]benzoylamino}-1-(2,4,6-trichlorophenyl)pyrazolon-5-one (a magenta coupler), tricresyl phosphate (oil), 4-hydroxy-6-methyl-1,3,3a,7-tetraazaindene (a stabilizer), sodium dodecylbenzenesulfonate (a coating aid), 1,2-bis (vinyl-sulfonylacetylamino) ethane (a hardening agent), and phenoxyethanol (an antiseptic), and each of the above emulsions and a coating solution for a gelatin protective layer containing polymethyl methacrylate particles were coated by a double extrusion method on a triacetyl cellulose film support having an undercoat layer.

These samples were subjected to sensitometry exposure (1 second) through an optical wedge using a 419 nm interference filter for measuring intrinsic sensitivity of the silver halide and an SC-50 filter (manufactured by Fuji Photo Film Co., Ltd.) for measuring spectral sensitivity, respectively, then development processed as follows. Each processed sample was measured for density with a green filter. The results obtained are shown in Table 1.

The sensitivity was reciprocal of exposure amount necessary to obtain the optical density of (fog value+0.5) and expressed by the relative value with the value of Sample No. 2 being taken as 100 with respect to intrinsic sensitivity and the value of Sample No. 2 being taken as 100 with respect to spectral sensitivity.

TABLE 1

| Sample No. | Potassium Thiocyanate (amount added) (mol/mol AgX) | Sulfur Compound | (amount added) (mol/mol AgX) | Dye Was Not Added: Fog | Dye Was Not Added: Intrinsic Sensitivity | Dye Was Added: Intrinsic Sensitivity | Dye Was Added: Spectral Sensitivity | Remarks |
|---|---|---|---|---|---|---|---|---|
| 1 | — | Comp. Cpd.-1 | $(06 \times 10^{-6})$ | 0.06 | 79 | 40 | 76 | Comparison |
| 2 | — | " | $(8 \times 10^{-6})$ | 0.06 | 100 | 52 | 100 | Comparison |
| 3 | — | " | $(12 \times 10^{-6})$ | 0.09 | 83 | 41 | 80 | Comparison |
| 4 | $8 \times 10^{-4}$ | " | $(6 \times 10^{-6})$ | 0.06 | 72 | 38 | 73 | Comparison |

TABLE 1-continued

| Sample No. | Potassium Thiocyanate (amount added) (mol/mol AgX) | Sulfur Compound | (amount added) (mol/mol AgX) | Dye Was Not Added: Fog | Dye Was Not Added: Intrinsic Sensitivity | Dye Was Added: Intrinsic Sensitivity | Dye Was Added: Spectral Sensitivity | Remarks |
|---|---|---|---|---|---|---|---|---|
| 5 | " | " | $(8 \times 10^{-6})$ | 0.07 | 98 | 64 | 124 | Comparison |
| 6 | " | " | $(12 \times 10^{-6})$ | 0.09 | 108 | 68 | 134 | Comparison |
| 7 | $2.4 \times 10^{-3}$ | " | $(8 \times 10^{-6})$ | 0.10 | 106 | 72 | 138 | Comparison |
| 8 | " | " | $(12 \times 10^{-6})$ | 0.15 | 64 | 45 | 86 | Comparison |
| 9 | — | Compound 1. | $(8 \times 10^{-6})$ | 0.06 | 71 | 45 | 90 | Invention |
| 10 | — | " | $(12 \times 10^{-6})$ | 0.06 | 102 | 63 | 124 | Invention |
| 11 | — | " | $(16 \times 10^{-6})$ | 0.06 | 104 | 64 | 126 | Invention |
| 12 | $8 \times 10^{-4}$ | " | $(8 \times 10^{-4})$ | 0.06 | 96 | 72 | 142 | Invention |
| 13 | " | " | $(12 \times 10^{-6})$ | 0.06 | 108 | 83 | 166 | Invention |
| 14 | $8 \times 10^{-4}$ | Compound 1. | $(16 \times 10^{-6})$ | 0.06 | 108 | 89 | 178 | Invention |
| 15 | $2.4 \times 10^{-3}$ | " | $(8 \times 10^{-6})$ | 0.06 | 110 | 92 | 184 | Invention |
| 16 | — | Comp. Cpd.-2 | $(8 \times 10^{-6})$ | 0.07 | 100 | 54 | 92 | Comparison |
| 17 | $8 \times 10^{-4}$ | " | $(8 \times 10^{-6})$ | 0.08 | 96 | 68 | 118 | Comparison |
| 18 | $2.4 \times 10^{-3}$ | " | $(8 \times 10^{-6})$ | 0.10 | 105 | 75 | 148 | Comparison |
| 19 | — | Compound 2. | $(8 \times 10^{-6})$ | 0.06 | 64 | 34 | 68 | Invention |
| 20 | — | " | $(12 \times 10^{-6})$ | 0.06 | 100 | 61 | 114 | Invention |
| 21 | $8 \times 10^{-4}$ | " | $(8 \times 10^{-6})$ | 0.06 | 95 | 81 | 164 | Invention |
| 22 | " | " | $(12 \times 10^{-6})$ | 0.06 | 107 | 96 | 188 | Invention |
| 23 | $2.4 \times 10^{-3}$ | " | $(8 \times 10^{-6})$ | 0.06 | 108 | 98 | 192 | Invention |
| 24 | — | Compound 5. | $(8 \times 10^{-6})$ | 0.06 | 71 | 46 | 90 | Invention |
| 25 | — | " | $(12 \times 10^{-6})$ | 0.06 | 100 | 64 | 128 | Invention |
| 26 | $8 \times 10^{-4}$ | " | $(8 \times 10^{-6})$ | 0.06 | 100 | 84 | 162 | Invention |
| 27 | $2.4 \times 10^{-3}$ | Compound 5. | $(8 \times 10^{-6})$ | 0.06 | 110 | 91 | 175 | Invention |
| 28 | — | Compound 13. | $(8 \times 10^{-6})$ | 0.06 | 74 | 50 | 98 | Invention |
| 29 | $8 \times 10^{-4}$ | " | $(8 \times 10^{-6})$ | 0.06 | 104 | 85 | 168 | Invention |
| 30 | $2.4 \times 10^{-3}$ | " | $(8 \times 10^{-6})$ | 0.06 | 108 | 90 | 177 | Invention |

Comparative Compound-1

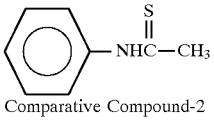

Comparative Compound-2

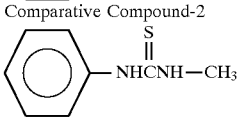

Processing Method

| Step | Processing Time | Processing Temperature (°C.) |
|---|---|---|
| Color Development | 2 min 15 sec | 38 |
| Bleaching | 6 min 30 sec | 38 |
| Washing | 2 min 10 sec | 24 |
| Fixing | 4 min 20 sec | 38 |
| Washing (1) | 1 min 05 sec | 24 |
| Washing (2) | 1 min 00 sec | 24 |
| Stabilization | 1 min 05 sec | 38 |
| Drying | 4 min 20 sec | 55 |

Composition of each processing solution are shown below.

| Color Developing Solution | |
|---|---|
| Diethylenetriaminepentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |

-continued

| | |
|---|---|
| Hydroxylamine Sulfate | 2.4 g |
| 4-(N-Ethy1-N-β-hydroxyethylamiino)-2-methylaniline Sulfate | 4.5 g |
| Water to make | 1.0 l |
| pH | 10.05 |
| **Bleaching Solution** | |
| Sodium Ethylenediaminetetraacetato Ferrate Trihydrite | 100.0 g |
| Disodium Ethylenediaminetetraacetate | 10.0 g |
| Ammonium Bromide | 140.0 g |
| Ammonium Nitrate | 30.0 g |
| Aqueous Ammonia (27%) | 6.5 ml |
| Water to make | 1.0 l |
| pH | 6.0 |
| **Fixing Solution** | |
| Disodium Ethylenediaminetetraacetate | 0.5 g |
| Sodium Sulfite | 7.0 g |
| Sodium Bisulfite | 5.0 g |
| Aqueous Solution of Ammonium Thiosulfate (70%) | 170.0 ml |
| Water to make | 1.0 l |
| pH | 6.7 |
| **Stabilizing Solution** | |
| Formalin (37%) | 2.0 ml |
| Polyoxyethylene-p-monononylphenyl Ether (polymerization degree: 10) | 0.3 g |

-continued

| | |
|---|---|
| Disodium Ethylenediaminetetraacetate | 0.05 g |
| Water to make | 1.0 l |
| pH | 5.0 to 8.0 |

As is apparent from the results of Table 1, a great advantage was obtained by using the compound of the present invention having an adsorptive group, compared with Comparative Compound-1 or -2 having no adsorptive group, such that even if a large amount of the compound was used, fog did not increase at all. However, slightly large amount of the compound was required to obtain optimal sensitization. When the thiocyanate compound was used in combination, however, sensitization was conspicuously accelerated and the same amount as the amount added of the comparative compound was sufficient and the achieved sensitivity was increased without increasing fog.

On the contrary, when the thiocyanate compound was used in combination with Comparative Compound-1 or -2, sensitization was a little increased but fog also increased at the same time, therefore, the amount added could not be reduced. The effect of the thiocyanate compound to the sulfur compound of the present invention could not be anticipated at all.

Further as is apparent from the results of Table 1, the achieved sensitivity of the sulfur compound of the present invention was almost the same as that of Comparative Compound-1 or -2 when the sensitizing dye was not used, but the spectral sensitivity when the dye was added was intrinsically high. Moreover, the spectral sensitivity was further increased when the thiocyanate compound was added. This was because the intrinsic sensitivity was improved by the sensitizing dye as is apparent from the change of the intrinsic sensitivity when the dye was added.

EXAMPLE 2

Silver bromide tabular grains having a thickness of 0.1 μm and a circle corresponding diameter of 0.7 μm were prepared as a seed crystal. The seed crystal containing 6 g of Ag was dissolved in 1.0 liter of a distilled water, the pAg was adjusted to 8.2, pH was adjusted to 5, the temperature was maintained at 70° C., and the solution was vigorously stirred. Subsequently, grain formation was carried out according to the procedure described below.

An aqueous solution of $AgNO_3$ (166 g) and an aqueous solution of KBr were added to the solution while keeping the pAg at 8.4. A reducing sensitizer, thiourea dioxide (1.5 mg), was added at this time.

The temperature was lowered to 55° C., and an aqueous solution of KI (8 g) was added thereto at a constant feed rate.

An aqueous solution of $AgNO_3$ (38 g) and an aqueous solution of KBr were added while maintaining the pAg at 8.9, and finally sodium benzenethiosulfonate (42 mg) was added.

Many dislocation lines were observed in the grains with an electron microscope.

The reaction system was cooled to 35° C., washed with water by an ordinary flocculation method, and 50 g of gelatin was added so that the pH and pAg were adjusted to 5.9 and 8.5, respectively. The emulsion contained tabular grains having an average sphere corresponding diameter of 0.85 μm, an aspect ratio of 3 or more, and accounting for 81% of the entire projected area of the grains. Many dislocation lines were confirmed in the grains with an electron microscope.

The emulsion was subdivided and the temperature of each emulsion was raised to 56° C., then anhydro-5,5'-dichloro-9-ethyl-3,3'-di(3-sulfopropyl)benzothiacarbocyanine hydroxide sodium salt was added. After 10 minutes, chloroauric acid ($4.2\times10^{-6}$ mol/mol of Ag), a selenium sensitizer, pentafluorophenyl-diphenylphosphine selenide ($3.2\times10^{-6}$ mol/mol of Ag), and potassium thiocyanate and a sulfur sensitizer shown in Table 2 were successively added with an interval of 2 minutes and each emulsion was ripened so as to obtain the optimal sensitivity by exposure of 1/100 sec.

Subsequently, the following compounds were added to each emulsion: 3-{3-[2-(2,4-di-tert-amylphenoxy)butyrylamino]benzoylamino}-1-(2,4,6-trichlorophenyl)pyrazolin-5-one (a magenta coupler), tricresyl phosphate (oil), 4-hydroxy-6-methyl-1,3,3a,7-tetraazaindene (a stabilizer), 1-(m-sulfophenyl)-5-mercaptotetrazole monosodium salt and 1-(p-carboxyphenyl)-5-mercaptotetrazole (antifoggants), sodium dodecylbenzenesulfonate (a coating aid), 1,2-bis(vinyl-sulfonylacetylamino)ethane (a hardening agent), and phenoxyethanol (an antiseptic), and each of the above emulsions and a coating solution for a gelatin protective layer containing polymethyl methacrylate particles were coated by a double extrusion method on a triacetyl cellulose film support having an undercoat layer.

These samples were subjected to sensitometry exposure (1/100 sec) through a yellow filter and color development—processed in the same manner as in Example 1.

The processed sample was measured for density with a green filter. The results obtained of photographic performances are shown in Table 2. The relative spectral sensitivity was reciprocal of exposure amount necessary to obtain the optical density of (fog value+maximum density/2) and expressed by the relative value with the value of Sample No. 41 being taken as 100.

TABLE 2

| Sample No. | Potassium Thiocyanate (amount added) (mol/mol AgX) | Sulfur Compound (amount added) (mol/mol AgX) | | Fog | Relative Spectral Sensitivity | Remarks |
|---|---|---|---|---|---|---|
| 41 | — | Comparative Compound-1 | $(9.6\times10^{-6})$ | 0.32 | 100 | Comparison |
| 42 | $1.5\times10^{-3}$ | Comparative Compound-1 | $(9.6\times10^{-6})$ | 0.29 | 109 | Comparison |
| 43 | — | Compound 1. | $(9.6\times10^{-6})$ | 0.18 | 92 | Invention |
| 44 | — | Compound 1. | $(1.5\times10^{-5})$ | 0.18 | 110 | Invention |
| 45 | $1.5\times10^{-3}$ | Compound 1. | $(9.6\times10^{-5})$ | 0.20 | 132 | Invention |

TABLE 2-continued

| Sample No. | Potassium Thiocyanate (amount added) (mol/mol AgX) | Sulfur Compound (amount added) (mol/mol AgX) | | Fog | Relative Spectral Sensitivity | Remarks |
|---|---|---|---|---|---|---|
| 46 | $1.5 \times 10^{-3}$ | Comparative Compound-3 | $(9.6 \times 10^{-6})$ | 0.28 | 94 | Comparison |

Comparative Compound-1: The same compound as in Example 1.
Comparative Compound-3: Sodium thiosulfate.

As is apparent from the results in Table 2, when the sulfur compound of the present invention was used, fog was suppressed to a very low level and the same or more spectral sensitivity could be obtained with increasing the amount a little.

Further, the sensitivity was increased conspicuously and high spectral sensitivity could be obtained when the sulfur compound of the present invention was used in combination with potassium thiocyanate.

In addition, fluctuations of fog and spectral sensitivity when the samples were preserved under high temperature high humidity conditions were less compared with those of the comparative compounds.

EXAMPLE 3

An aqueous solution of silver nitrate (480 ml, water was added to 170 g of $AgNO_3$), 0.3 mg of hexa-chlorinated iridium potassium salt and an aqueous solution of sodium chloride (480 ml, water was added to 59 g of NaCl) were added at the same time to 800 ml of an aqueous solution containing 3.3 g of sodium chloride and 25 g of gelatin dissolved therein having pH of 4.5 and maintained at 55° C. One minute before completion of addition, an aqueous solution containing 0.18 g of potassium thiocyanate and 1.2 g of KBr was added thereto. The emulsion obtained was a cubic monodisperse silver chloride emulsion having a grain size of 0.45 $\mu$m in terms of side length.

Then, the emulsion was washed with water by an ordinary flocculation method using a high molecular coagulant and desalted. Subsequently, 76 g of gelatin and water were added to the emulsion to adjust pH and pAg to 6.2 and 7.0, respectively.

The emulsion was subdivided and the temperature was raised to 55° C., and after sensitizing dye, anhydro-5,5'-diphenyl-9-ethyl-3,3'-(3-sulfoethyl)benzoxacarbocyanine hydroxide pyridinium, was added, the sulfur compound shown in Table 3 was added and the emulsion was ripened for 40 minutes.

Subsequently, gelatin and water and the following compounds were successively added to each emulsion: 4-hydroxy-6-methyl-1,3,3a,7-tetraazaindene (a stabilizer), 1-[3-(3-methylureido)phenyl]-5-mercaptotetrazole (a stabilizer), sodium dodecylbenzenesulfonate (a coating aid), and 2,4-dichloro-6-hydroxy-s-triazine sodium salt (a hardening agent), and each emulsion and a coating solution for a gelatin protective layer were coated on a paper support both surfaces of which were laminated with polyethylene to obtain samples.

Each sample was subjected to exposure (1/10 sec) using an optical wedge through a yellow filter. After being black-and-white development processed at 20° C. for 5 minutes with the following developing solution, each sample was stopped, fixed, washed with water, dried and measured for density. The results obtained are shown in Table 3. The relative spectral sensitivity was reciprocal of exposure sss amount necessary to obtain the density of (fog value+0.5) and expressed by the relative value with the value of Sample No. 51 being taken as 100.

The composition of the processing solution are shown below.

| | |
|---|---|
| Metol | 2.5 g |
| L-Ascorbic Acid | 10.0 g |
| Nabox | 35.0 g |
| KBr | 1.0 g |
| Water to make | 1.0 l |
| pH (adjusted) | 9.6 |

TABLE 3

| Sample No. | Sulfur Compound (amount added) (mol/mol AgX) | | Fog | Relative Spectral Sensitivity | Remarks |
|---|---|---|---|---|---|
| 51 | Comparative Compound-1 | $(4 \times 10^{-6})$ | 0.12 | 100 | Comparison |
| 52 | Compound 1. | $(4 \times 10^{-6})$ | 0.06 | 124 | Invention |
| 53 | Compound 4. | $(4 \times 10^{-6})$ | 0.06 | 118 | Invention |
| 54 | Compound 19. | $(4 \times 10^{-6})$ | 0.05 | 116 | Invention |
| 55 | Compound 25. | $(4 \times 10^{-6})$ | 0.07 | 120 | Invention |

Comparative Compound-1: The same compound as in Example 1.

It can be clearly understood from the results in Table 3 that in the silver chloride emulsion to which potassium thiocyanate was used during grain formation, fog was suppressed to a low level by the sulfur sensitizer of the present invention and high spectral sensitivity could be obtained.

When color development was carried out by adding couplers, the same results were obtained.

EXAMPLE 4

Emulsion 21 prepared in Example 1 was used in the fifth layer of the photographic material of Sample 6 (Sample No. 101) in Example 3 of JP-A-6-258788 and the sample was subjected to the same processing as in Example 3 of that patent. As a result, good performance was obtained.

EXAMPLE 5

Emulsion 12 prepared in Example 1 was used as the emulsion of Photographic Material-X in Example 1 of JP-A-6-273860 and the sample was processed in the same manner as in the same example of that patent in combination with screen B. As a result, good performance was obtained.

While the invention has been described in detail and with reference to specific examples thereof, it will be apparent to one skilled in the art that various changes and modifications can be made therein without departing from the spirit and scope thereof.

What is claimed is:

1. A silver halide photographic emulsion which is chemically sensitized with a compound represented by formula (I):

$$A—[(W)_n—Z]_m \quad (I)$$

in the presence of a thiocyanate selected from the group consisting of potassium thiocyanate, sodium thiocyanate, and ammonium thiocyanate, wherein in formula (I):

A is selected from the group consisting of mercapto, thione, and an atomic group forming imino silver; W represents a divalent linking group; n represents 0 or 1; Z is selected from the group consisting of a thiourea group, thioamide group, phosphine sulfide group, rhodanine group, thiohydantoin group, oxazolidine group, polysulfide group, dithiazolidine group, and a thiocarbamate group; and m represents 1, 2 or 3.

2. The silver halide photographic emulsion as claimed in claim 1, wherein the compound represented by formula (I) is used in an amount of from $1\times10^{-8}$ to $1\times10^{-2}$ mol per mol of the silver halide.

3. The silver halide photographic emulsion as claimed in claim 1, wherein the oxazolidine group is a 4-oxooxazolidine-2-thione group, or the polysulfide group is a disulfide group.

4. The silver halide photographic emulsion as claimed in claim 1, wherein said silver halide emulsion is further reduction-sensitized during silver halide grain formation.

5. The silver halide photographic emulsion as claimed in claim 1, wherein said silver halide emulsion is further subjected to selenium-sensitization or tellurium-sensitization.

6. The silver halide photographic emulsion as claimed in claim 1, wherein said silver halide emulsion is subjected to gold-sensitization.

7. The silver halide photographic emulsion as claimed in claim 1, wherein said silver halide photographic emulsion is spectrally sensitized with a methine dye.

8. The silver halide photographic emulsion of claim 1, wherein A is selected from the group consisting of A is mercapto and thione.

9. The silver halide photographic emulsion of claim 1, wherein Z is selected from the group consisting of a thiourea group, a thioamido group, a phosphine sulfide group and a rhodamine group.

10. The silver halide emulsion of claim 1, wherein Z is:

$$—C(=S)NH—.$$

11. A silver halide photographic material comprising:

a support having coated thereon at least one silver halide emulsion layer, wherein at least one of said at least one silver halide emulsion layer contains a silver halide photographic emulsion chemically sensitized with a compound represented by formula (I):

$$A—[(W)_n—Z]_m \quad (I)$$

in the presence of a thiocyanate selected from the group consisting of potassium thiocyanate, sodium thiocyanate, and ammonium thiocyanate, wherein in formula (I):

A is selected from the group consisting of mercapto, thione, and an atomic group forming imino silver; W represents a divalent linking group; n represents 0 or 1; Z is selected from the group consisting of a thiourea group, thioamide group, phosphine sulfide group, rhodanine group, thiohydantoin group, oxazolidine group, polysulfide group, dithiazolidine group, and a thiocarbamate group; and m represents 1, 2 or 3.

12. The silver halide photographic emulsion of claim 1, wherein Z is a mercapto group further substituted on an aryl group.

13. The silver halide photographic emulsion of claim 1, wherein said methine dye is a cyanine dye.

14. The silver halide photographic emulsion of claim 1, wherein the emulsion which is sensitized is selected from the group consisting from silver bromide, silver iodobromide, silver iodochlorobromide, silver chlorobromide, and silver chloride.

15. The silver halide photographic emulsion of claim 1, wherein the silver halide emulsion grains have dislocation lines.

16. A silver halide photographic material comprising:

a support having coated thereon at least one silver halide emulsion layer, wherein at least one of said at least one silver halide emulsion layer contains a silver halide photographic emulsion chemically sensitized with a compound represented by formula (I):

$$A—[(W)_n—Z]_m \quad (I)$$

in the presence of a thiocyanate selected from the group consisting of potassium thiocyanate, sodium thiocyanate, and ammonium thiocyanate, wherein in formula (I):

A is selected from the group consisting of mercapto, thione, and an atomic group forming imino silver; W represents a divalent linking group; n represents 0 or 1; Z is selected from the group consisting of a thiourea group, thioamide group, phosphine sulfide group, rhodanine group, thiohydantoin group, oxazolidine group, polysulfide group, dithiazolidine group, and a thiocarbamate group; and m represents 1, 2 or 3.

* * * * *